United States Patent [19]

Bührer

[11] 4,167,208

[45] Sep. 11, 1979

[54] METHOD AND APPARATUS FOR THE PRODUCTION OF FOUNDRY MOLDS

[76] Inventor: Erwin Bührer, Vögelingässchen 40, 8200 Schaffhausen, Switzerland

[21] Appl. No.: 914,969

[22] Filed: Jun. 12, 1978

[30] Foreign Application Priority Data

Jun. 15, 1977 [CH] Switzerland ..... 7338/77

[51] Int. Cl.[2] ..... B22C 15/02; B22C 25/00

[52] U.S. Cl. ..... 164/18; 164/181; 164/210

[58] Field of Search ..... 164/18, 24, 27, 29, 164/40, 180, 181, 187, 194, 210, 213

[56] References Cited

U.S. PATENT DOCUMENTS

| | | | |
|---|---|---|---|
| 2,985,931 | 5/1961 | Frankenstein | 164/18 |
| 3,273,208 | 9/1966 | Greenberger | 164/337 X |
| 3,318,365 | 5/1967 | Isaev et al. | 164/210 X |
| 3,802,487 | 4/1974 | Feller | 164/194 |
| 3,998,263 | 12/1976 | Iten | 164/181 |

FOREIGN PATENT DOCUMENTS

| | | | |
|---|---|---|---|
| 2529982 | 2/1976 | Fed. Rep. of Germany | 164/213 |
| 520080 | 3/1955 | Italy | 164/210 |
| 47-24336 | 7/1972 | Japan | 164/210 |
| 50-35009 | 11/1975 | Japan | 164/180 |
| 52-11932 | 4/1977 | Japan | 164/213 |
| 728278 | 4/1955 | United Kingdom | 164/210 |
| 152728 | 2/1963 | U.S.S.R. | 164/210 |

*Primary Examiner*—Robert D. Baldwin
*Attorney, Agent, or Firm*—Toren, McGeady and Stanger

[57] ABSTRACT

A system for producing foundry molds providing a device for filling empty mold boxes with mold forming material at a filling station includes a first rotary shifting device and a second rotary shifting device located on opposite sides of the filling station. The first shifting device operates to shift pattern devices from the filling station to a first shifting station while simultaneously moving another pattern device from the first shifting station into position at the filling station. Likewise, the second shifting device moves mold halves from the filling station to a second shifting station while simultaneously moving an empty mold box from the second shifting station to the filling station. The pattern devices are moved to and from the first shifting station by a first conveyor device and the empty mold boxes and the mold halves are moved to and from the second shifting station by a second conveyor device which extends generally parallel to the first conveyor device. A third parallel conveyor device transports assembled filled mold boxes and pattern devices from the filling station to a single-station mold forming unit.

20 Claims, 10 Drawing Figures

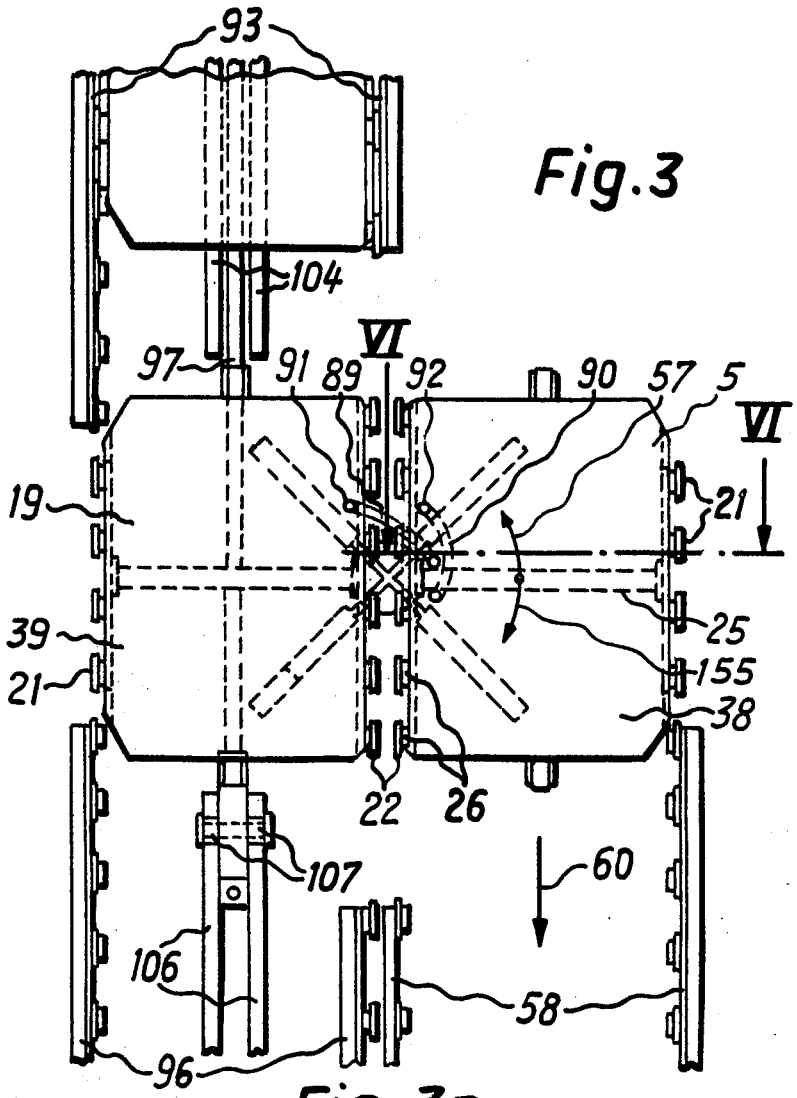
Fig.3
Fig.3a
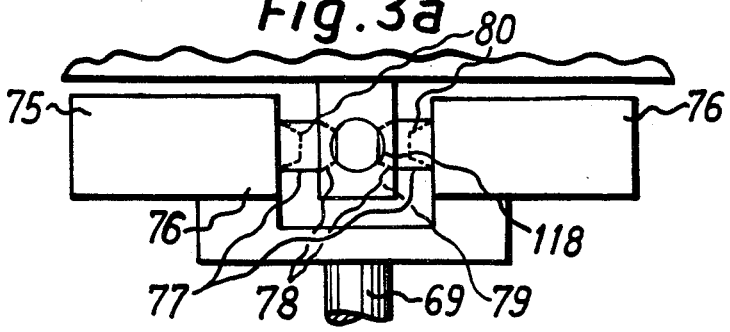

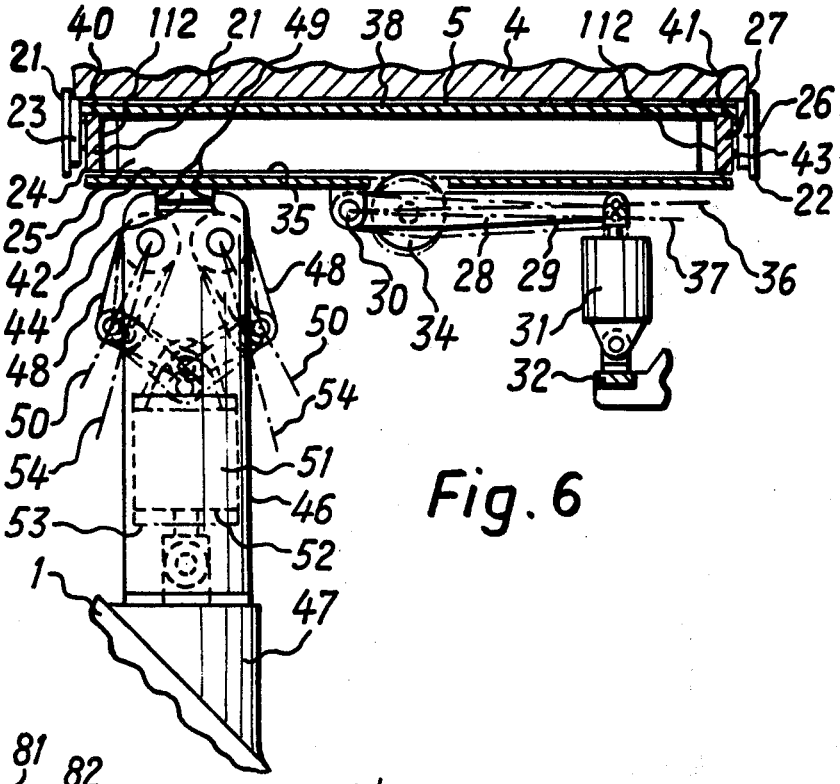
Fig. 6
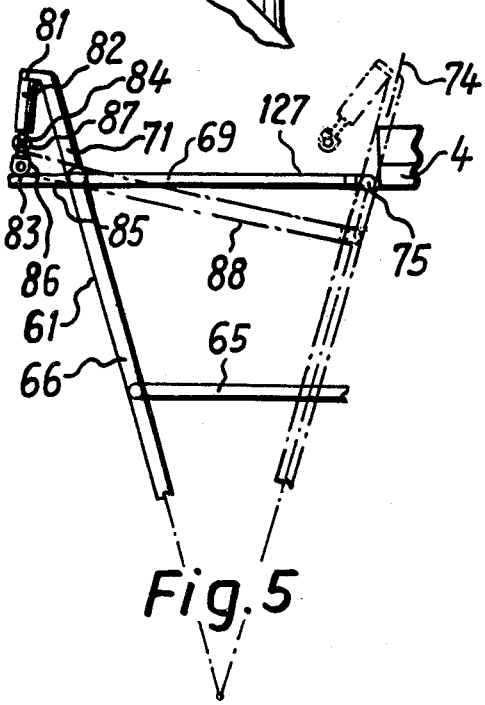
Fig. 5
Fig. 3b
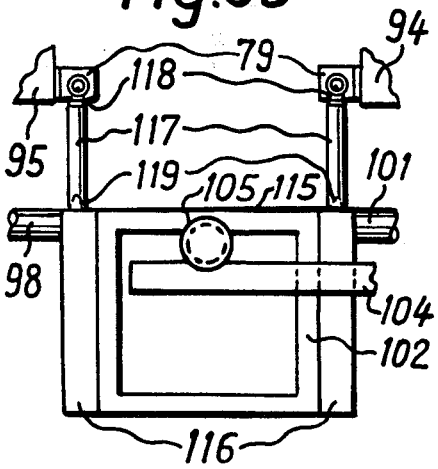

METHOD AND APPARATUS FOR THE PRODUCTION OF FOUNDRY MOLDS

BACKGROUND OF THE INVENTION

The present invention relates generally to apparatus for producing foundry molds and is more particularly directed to a system whereby foundry molds may be produced in mold halves by utilization of a single-station molding unit. Furthermore, the invention is directed toward a system which facilitates selective utilization of any one of a plurality of differently configured pattern devices simply by introducing such devices into the flow stream of the system. The system may be continuously operated by feeding empty mold boxes thereto, feeding pattern devices thereto and continuously transporting mold halves from the system.

In known apparatus of this type, pattern devices are generally moved on a conveyor track with molding boxes, particularly boxes adapted to form therein mold halves, being conveyed on a second track with the two tracks being arranged in a crossing configuration. A press head having an attached sand filling device may be moveable parallel to the conveyor track for the molding boxes which is directed to pass through a machine frame composed of the molding unit. Additionally, the molding unit is formed with lifting and lowering devices for bringing the pattern plates and molding boxes together during the mold forming operation Depending on the type of mold halves which are to be. produced, pattern devices must be alternately moved into the molding unit from one of several waiting or standby positions. In the case of the aforementioned prior art system, the standby positions are separated from each other by the machine frame and the conveyor track for the molding boxes.

Known apparatus of this type has the disadvantage that operations which must be performed on the pattern devices while they are disposed in the standby position will require more than a single operator because of the spatial separation of the positions of the pattern devices. The operations referred to include cleaning and placing of chills, and it is desirable if such operations can be performed with greater efficiency and economy.

A more significant disadvantage of prior art devices resides in the fact that most of the partial operations which must be performed in producing a mold half must be performed within the molding unit. This fact has the result that respective partial operations must be performed successively, thereby resulting in relatively long station times and in comparatively low apparatus efficiencies.

SUMMARY OF THE INVENTION

The present invention is intended to provide a system and apparatus for the production of foundry molds in mold halves wherein station times are shortened and wherein simultaneous performance of a plurality of partial operations may be enabled.

Basically, the invention comprises a pair of rotary shifting devices located on opposite sides of a filling station where filling of mold boxes with molding sand or other mold forming material may occur. A sand filling device is arranged vertically above the filling station and each of the shifting devices located on opposite sides thereof operate to transport through basically circular travelling paths pattern devices, on the one hand, and empty mold boxes and mold halves on the other hand. The first rotary shifting device operates to move a pattern device through a semicircular path from a first shifting station to the filling station. The second rotary shifting device operates to move through a generally semicircular path an empty mold box from a second shifting station to the filling station. At the filling station the mold box and the pattern device are assembled, they are filled with mold forming material such as sand, and they are transported to a mold forming unit where mold forming operations, such as compacting of the mold forming material, may be performed. Subsequently, the assembled, filled and compacted mold, which may be half of a complete mold, is returned to the filling station where the pattern device is separated from the mold half whereupon the first shifting device moves the pattern device from the filling station back to the first shifting station while the second shifting device moves the mold half from the filling station back to the second shifting station. Simultaneously with rotation of the pattern device and the mold half to their respective first and second shifting stations, the first and second shifting devices also move to the filling station another pattern device and a subsequent empty mold box for filling and processing in the same manner as the first mold assembly. The mold half may be transported from the second shifting station and pattern devices may be removed from and introduced to the first shifting station in any selected sequence.

The invention comprises first conveyor means which operate to transport pattern devices to and from the first shifting station and which may also define standby stations for the pattern devices, with second conveyor means being provided for transporting empty mold boxes to the second shifting station and for transporting mold halves away therefrom. Third conveyor means operate to transport filled assembled molds to the mold forming unit from the filling station and to return the compacted mold half assemblies back to the filling station. The first, second and third conveyor means may be arranged to extend parallel to each other.

The shifting devices are essentially rotary tables each having an axis of rotation and each defining a pitch radius of the travelling circular track through which the device operates. The first shifting device is located between the first conveyor means and the third conveyor means and the second shifting device is located between the second conveyor means and the third conveyor means. The shifting devices are, thus, located on diametrically opposed sides of the filling station and their axes of rotation are spaced apart a distance equivalent to the sum of their pitch radii. Furthermore, the second shifting device is arranged to transport the mold boxes through a horizontal plane which extends above a horizontal plane through which the first shifting device transports the pattern devices. Thus, when brought into the filling station by the first shifting device, each pattern device will be located directly below an empty mold box which has been brought into the filling station by the second shifting device. The sand filling means located directly thereabove will operate to fill the empty mold box after assembly with the pattern device.

Due to the fact that the shifting devices operate to transport the pattern devices and the molding boxes in different horizontal planes, it becomes possible with the present invention to simultaneously exchange pattern devices by a single 180° rotation of the first shifting means which may operate to move one pattern device into the filling station while simultaneously moving another pattern device away therefrom. Likewise, the second shifting device may simultaneously move a finished mold half out of the filling position while at the same time moving an empty mold box into the filling position. Additionally, many of the operations of the system may be performed simultaneously. For example, at the same time that a finished mold half is returned to the second shifting station to be withdrawn from the system by the second conveyor means, the second conveyor means may be simultaneously moving an empty molding box into the second shifting position for subsequent delivery to the filling station. At the same time, other operations may be taking place, such as filling of a mold box located at the filling station, movement of a new pattern device into the first shifting station or processing of a pattern device for subsequent utilization.

Furthermore, during the mold forming or compacting operations that may be provided in the molding unit, the finished mold half previously transported to the second shifting station may be transported out of the system while an empty box may be moved into a standby position onto the second conveyor means.

Further favorable characteristics of the invention which contribute significantly to the shortening of station times involve the fact that it is not necessary to move heavy machine parts to the molding unit and that the pouring of the sand may take place at a location outside the molding unit. As a result, when the pattern device carrying the filled mold boxes is moved into the molding unit, excess molding sand can be drawn off while this movement is being performed.

By utilizing a shifting device for the selective or alternate positioning of one of a plurality of pattern devices into the stream of operations, it is possible to perform needed work on the pattern devices at a single standby position or at a single location while the pattern device is out of the flow stream of the production process. In this regard, it is also of significance that exchange of pattern devices may be readily performed at a single standby location after certain operations thereon have been completed.

In accordance with a preferred embodiment of the invention, roller tables are utilized to define the standby position of the pattern devices. These roller tables will allow exchange of pattern devices after operations thereon have been completed during a first station time with similar operations being enabled on a second pattern device during a subsequent station time. Thus, a continuous production flow system may be performed with new pattern devices being introduced into the system without interruption.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the Drawings:

FIG. 3 is a partial plan view of a rotary table embodying the first shifting means of the apparatus and depicting cooperating actuating means, the shifting means being shown without pattern devices thereon;

FIG. 3*a* is a partial view showing in elevation coupling means between a pattern device and actuating means for moving the device during operation of the invention;

FIG. 3*b* is a partial elevational view showing actuating means for the pattern devices and the coupling therebetween;

FIG. 5 is an elevational view showing in greater detail in actuating device for propelling filled assembled molds between the filling station and the molding unit of the apparatus along the third conveyor means;

FIG. 6 is a partial sectional view of a portion of the rotary table of the first shifting means depicting associated equipment and taken along the line VI—VI of FIG. 3;

DETAILED DESCRIPTION OF THE PREFERRED EMBODIMENTS

Figure 1:
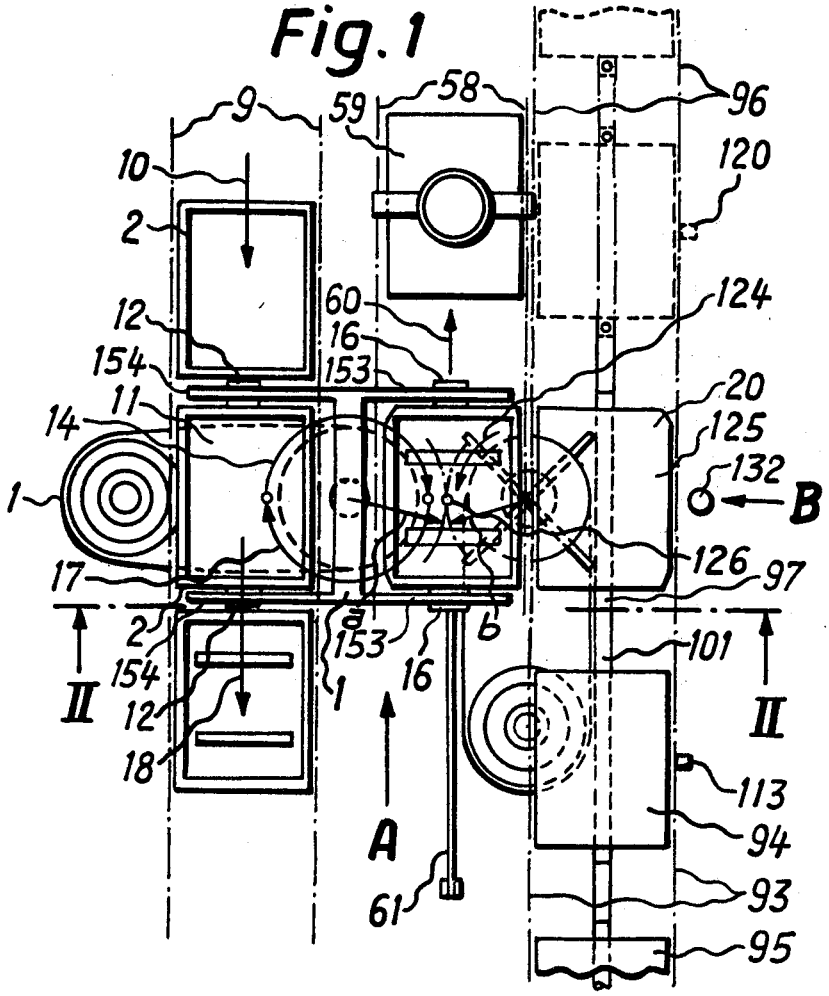
FIG. 1 is a plan view of a first embodiment of the apparatus of the invention.

Referring now to the drawings, wherein like reference numerals are used to denote similar parts throughout the various figures thereof and with more specific reference to FIGS. 1–6 depicting a first embodiment of the invention, the overall system of the invention is perhaps best seen in FIG. 1 where a single-station molding unit 59 is provided in the form, for example, of a jolting-sqeezing molding machine known per se which may preferably comprise a free-fall jolt-squeeze molding machine within which filled mold boxes may be processed.

Figure 2:
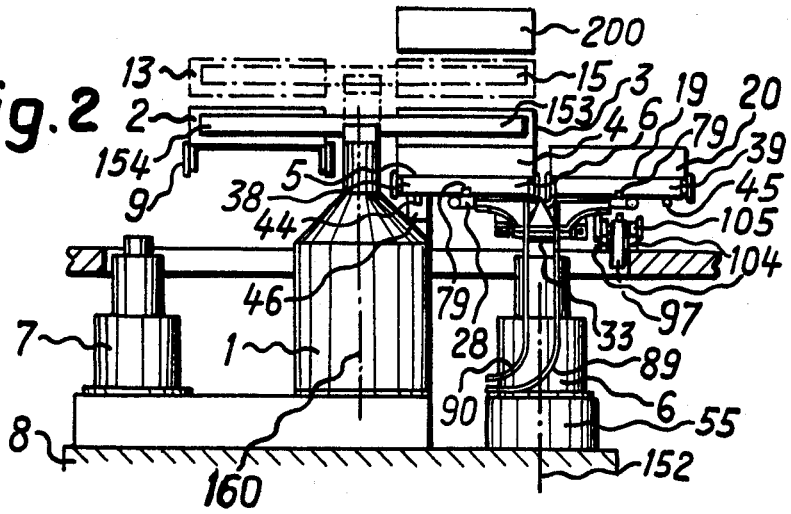
FIG. 2 is a sectional side view of the apparatus taken along the line II—II of FIG. 1 and showing the apparatus as viewed in the direction of the arrow A.

The molding unit 59 is provided with filled mold boxes along conveyor means 58 which may be in the form of sliding tracks and which comprise the third conveyor means of the invention, filled mold boxes being delivered in the direction of an arrow 60 from a location 126 constituting the filling station 126 of the system of the invention. Located directly over the filling station 126 as best seen in FIG. 2, is a sand filling device 200 which may provide sand or other mold forming material which may be filled into empty mold boxes located at the filling station 126 directly beneath the filling device 200.

At the filling station 126, empty mold boxes and pattern devices are brought together and assembled, then they are filled with molding material, moved to the molding unit 59 along the third conveyor means 58, returned to the filling station 126 and then separated and further conveyed along the system of the invention, as will be described in more detail hereinafter.

In order to perform the basic operations of assembling the pattern devices and the empty molding boxes at the filling station 126, the invention basically comprises a first shifting means 6 in the form of a rotary table which operates to deliver pattern devices to the filling station 126 and to remove pattern devices therefrom. A second shifting device 1, also in the basic form of a rotary table likewise operates to deliver empty mold boxes to the filling station 126 and to remove mold halves therefrom.

Empty molding boxes 2 are delivered along second conveyor means comprising roller or conveyor tracks 9 in the direction of an arrow 10 to a second shifting station 11. After they have reached the second shifting station 11, the empty mold boxes 2 are transported by the second shifting means 1 from the second shifting station 11 to the filling station 126.

Pattern devices, such as the pattern devices 4 and 20, are selectively moved to a first shifting station 125 by means of first conveyor means which are essentially formed to include roller conveyors or tables 93 and 96. After a particular pattern device, such as either the device 4 or 20, is brought to the first shifting station 125, it is transported to the filling station 126 by the first shifting means 6.

Thus, as will be developed in more detail hereinafter, the system of the present invention operates to deliver a selected one of a plurality of pattern devices, such as for example pattern device 4, to the first shifting station 125 and to subsequently bring the pattern device 4 into position at the filling station 126 by appropriate rotary motion of the first shifting means 6.

Similarly, an empty molding box 2 may be moved to the second shifting station 11 and thereafter transported to the filling station 126 by appropriate rotation of the second shifting means 1. After delivery to the filling station 126, empty mold box 2 and the pattern device 4 may be assembled and filled with mold forming material from the filling device 200. The filled mold box and pattern device are subsequently delivered to the molding unit 59 along the third conveyor means 58 by operation of an actuating device 61. After performance of mold forming operations, the finished mold is returned to the filling station 126 where the pattern device 4 is disassembled from the compacted finished mold. Again by operation of the first and second shifting means 6 and 1, the pattern device 4 and the finished mold, which is now identified with the numeral 3, are returned, respectively, to the first and second shifting stations 125, 11 from the filling station 126.

In the case of the pattern device 4 this occurs by operation of the first shifting means 6. However, prior to return of the filled mold 3 back to the filling station 126 from the molding unit 59, another or different device 20 may be placed at the first shifting station 125. As a result, when the first shifting means 6 is rotated to move the pattern device 4 from the filling station 126 to the first shifting station 125 it may simultaneously move the pattern device 20 from the first shifting station 125 to the filling station 126.

In a similar manner, the second shifting means 1 may also operate to move a second empty molding box into position at the filling station 126 from the second shifting station 11 while simultaneously moving a mold half or mold unit 3 from the filling station 126 back to the second shifting station 11.

After being located at the shifting station 11, the filled mold unit 3 may be removed therefrom in the direction of the arrow 18 by further operation of the second conveyor means 9.

Similarly, after removal from the filling station 126, a pattern device such as the pattern device 4 may be removed from the first shifting station 125 for appropriate cleaning or other similar operations and then returned thereto at a later time for subsequent use.

It should be understood that the preferred embodiment of the invention described herein and depicted in the drawings is of the type which operates to produce molds by producing one-half of the mold at a given time. Thus the filled compressed mold unit identified by the number 3 may be considered to comprise a mold half which may be joined together with another complementary mold half each produced in sequence in the apparatus of the invention. For example, the pattern device 4 may be utilized to manufacture one-half of a mold unit while the pattern device 20 may be utilized to manufacture the complementary half, the pattern devices 4 and 20 being structured with differing configurations. Similarly, different pattern devices may be introduced to and withdrawn from the system as will be clear from the disclosure contained herein.

Empty molding boxes 2 are moved, in a fixed-cycle type of operation along the second conveyor means 9 which may be constructed, by way of example, as a roller table, in the direction of the arrow 10 into the second shifting station 11. The second shifting means or device 1 is constructed as a lifting and turning device including a clamping device 16 or 12 which may be arranged at a pair of cantilever arms 153 and 154, the clamping devices 16, 12 operating to grasp a single mold box 2 at the station 11, lift it to a position 13, best seen in FIG. 2, and subsequently lower it after rotation through 180° in a clockwise direction indicated by the arrow 14 shown in FIG. 1 from an uppermost position 15 over the filling station 126 onto a pattern device 4 which has been previously brought into position in the manner previously described at the filling station 126. The pattern device 4 rests upon a bearing surface 5 which is formed by a table half 38 comprising part of the rotary table 6 constituting the first shifting means.

At the same time, a mold half 3 which had been resting upon the pattern device 4 after having been previously filled and compacted is grasped by the clamping devices 16 of the second shifting means, it is lifted and rotated in the direction of the arrow 17 and lowered onto the roller table 9 at the second shifting station 11 from which the mold halves 3 are moved in a fixed cycle operation in the direction of the arrow 18.

It should be noted that the shifting devices formed by the lifting and turning device 1 and the rotary table 6 have vertical axes of rotation which are parallel relative to each other. It should also be noted that the distance between these axes of rotation corresponds to the sum of the pitch radii a and b of the circular travelling tracks indicated in FIG. 1. The lifting and turning device 1 together with its drive 7, and the rotary table 6 together with its drive 56 rests upon a joint foundation 8.

During the time that the table half 38 of the rotary table 6 carries upon its bearing surface 5 a pattern device 4, the pattern device 20 is supported on a diametrically opposed table half 39 which has a bearing surface 19. Sets of rollers 21 and 22 are assigned to the table half 38. The rollers 23 of the set of rollers 21 are supported in a support frame 24 which is connected to a cross piece 25. The rollers 26 of the set of rollers 22 are supported in a support 27 and also connected to the cross piece 25. By means of a lifting device 28 consisting of a lever 29 pivoted to this device, and by a cylinder 31 connected to the lever 29, the cylinder 31 resting on a console 32 connected to the rotary column 33, the cross piece 25 may be lifted by means of a roller 34 attached to the lever 29 into the position 35 shown in FIG. 6. The supports 24 and 27 are guided along guide faces 112 of the table half 38. In the position 35, the parts 24 and 27 are adjoined with the faces 40, 41 of the table half 38, the pattern device 4 being supported by the rollers 23 and 26. The bearing surface 5 is thereby unloaded. By reversing the cylinder 31, the lifting device 28 can be lowered from the position 36 into the position 37, at which the parts 24 or 27 are adjoined to the faces 42 or 43 of the table half 38. In this case, the pattern device 4 rests upon the bearing surface 5 and the set of rollers 21 and 22 are unloaded.

The basic design and configuration of the table half 39 corresponds to that of table half 38 of the first shifting means 6.

The table half 38 includes a cam 44 and the table half 39 has a cam 45. As best seen in FIG. 6, a clamping device 46 rests upon and is connected to a stationary console 47. A pair of clamping levers 48 operate through clamping faces 49 to hold the table half 38 through the cams 44 in the clamping position 50. In this position, the cylinder 51 is in a position 52. By reversing the cylinder 51 it may be moved into the position 53 and, thus, the clamping levers 48 may be moved into the position 54. In this position, the clamping levers 48 release the cam 44. When the rotary table 6 is rotated by a half turn, the cam 45 is moved into the place of the cam 44 and the table half 39 may be held through the clamping device 46 through the cams 45.

The table halves 38 and 39 are attached to a rotary column 33 which is supported in a housing 55. A drive 56 rotates the table halves 38 and 39 in the direction of the arrows 37 half a turn at a time so that the table half 38 is moved into the position of the table half 39 and the table half 39 is moved into the position of the table half 38 with the drive 56 rotating the table halves 38 and 39 back in the direction of the arrow 155.

When the pattern device 4 is in its raised position 35 as shown in FIG. 6, it is supported by the roller conveyors 21 and 22. In this position, it can be driven for transport by an actuating device 61 from the table half 38 in the direction of an arrow 60 through the roller conveyors 58 into the single-station molding unit 59 and back. The actuating device 61, best seen in FIGS. 1, 3*a*, 4 and 5, consists of a gear motor 62 mounted upon a base 63, a driving crank 64, a connecting rod 65, a rocking lever 66 connected to the rod 65, rocking lever 66 being connected also to a console 67 resting upon a base 68 and to a push rod 69. A crank position labeled 70 corresponds to a position 71 of the rocker lever 66. When the driving crank 64 makes a half turn in the direction of arrow 72, the crank 64 moves from crank position 70 into a crank position 73 and thus moves the rocker lever 66 from the position 71 into position 74.

The push rod 69 may be coupled to a pattern device such as the pattern device 4 through a coupling 75. The push rod 69 is uncoupled only in the position 71 and 74, this being effected by reversing the cylinder 76. The piston rods 77 interacting with the bores 78 of the coupling flange 79 are retracted into a position 80, whereby the pattern device 4 is uncoupled from the push rod 69. The push rod 69 and the pattern device 4 may freely move in this position independently and vertically.

As seen in FIG. 5, a cylinder 82 mounted at the upper end 81 of the rocking lever 66 includes a piston rod 84 which, when in an extended position 83, is in contact with an extension 85 of the push rod 69 through a roller 86, the rocker lever 66 being in position 71. When the cylinder 82 is reversed, the rocker lever 66 being in the position 71 and the coupling 75 being uncoupled, the piston rod 84 is retracted from position 83 into position 87 and the push rod 69 is lowered into the position 88. In position 88, the push rod 69 is out of the range of rotation of the rotary table 6 and of the pattern devices 4 and 20.

The system is provided with a vacuum line 89 which opens onto the bearing surface 19 of the table half 39 through an outlet bore 91. Another vacuum line 90 opens at the bearing surface 5 of the table half 38 through an outlet bore 92. Both the vacuum 89 and 90 are controlled by control valves (not shown). The location of the outlet 91 and 92 of the vacuum lines is shown only in exemplary fashion with regard to their positions on the bearing surfaces 19 and 5 inasmuch as the locations of these bores will depend upon the particular design of pattern devices, such as the pattern devices 20 and 4, which are to be utilized. The bearing surfaces 19 and 5 are advantageously constructed as flat finished surfaces without indentations. Sealing means and recesses required to effect a suction action on pattern devices located on the bearing surfaces 19 and 5 are advantageously provided on the pattern devices themselves and the pattern devices 20 and 4 are so equipped.

Figure 4:
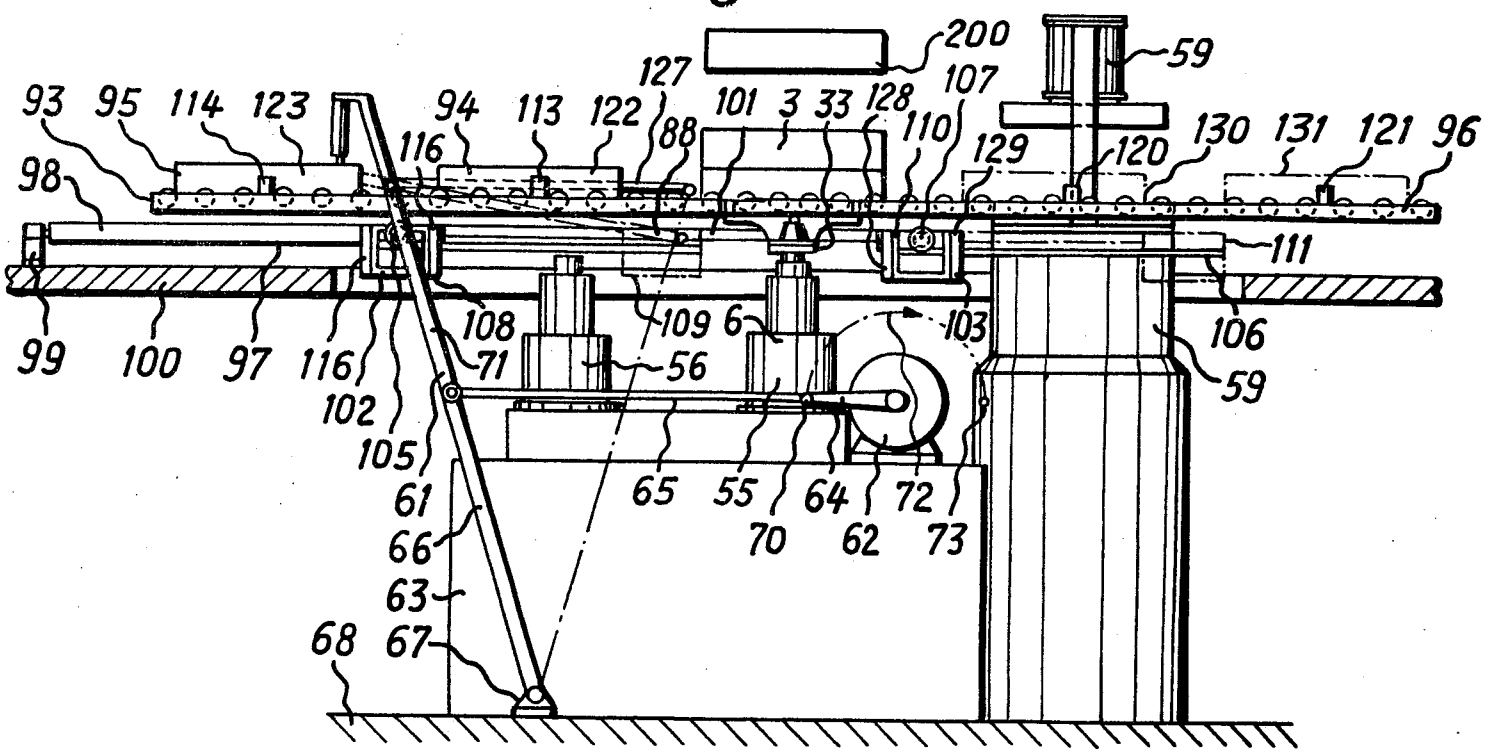
FIG. 4 is a side view of the apparatus of FIG. 1 as viewed in the direction of the arrow B.

Referring to FIGS. 1, 3 and 4, a roller table 93 is arranged to define a standby position for pattern devices and pattern devices 94 and 95 are shown as located in the standby position available for subsequent exchange with other pattern devices. Another roller table 96 is shown ready to receive the pattern devices 4 and 20 after they have been emitted from the shifting device 6 subsequent to a mold forming operation. Thus, as pattern devices are separated from finished molds at the filling station 126 and subsequently shifted to the first shifting station 125, they may be removed therefrom by the roller table 96 and subsequent pattern devices such as the devices 94 and 95 may be substituted therefor at the first shifting station by movement along the roller table 93.

With reference to FIGS. 1–3, 3*b* and 4, the apparatus is equipped with actuator means 97 which consist of a pressure cylinder 98 resting upon a base 100 through a console 99. The actuator means 97 also consist of a carriage 102 which is connected to the pressure cylinder 98 as well as to a carriage 103 through the connecting rod 101. The carriage 102 may be moved along the rails 104 on rollers 105 from a position 108 into a position 109. The carriage 103 may be moved on rails 106 through rollers 107 from position 110 into a position 11.

The carriage 102 consists of a middle portion 115 having attached rollers 105 with pressure cylinders 116 rigidly connected on both sides. The piston rods 117 of the pressure cylinder 116 can engage conical bores 118 of coupling flange 79 of the pattern devices, such as for example the pattern devices 94 and 95, and they can thus hold these pattern devices in operative engagement. Reversing the pressure cylinder 116, the piston rods 117 can be retracted into the position 119 at which the piston rods 117 will release the pattern devices 94 and 95.

The pressure cylinder 113 can hold the pattern device 94 and the pressure cylinder 114 holds the pattern device 95. The design of the pressure cylinders 128 and 129 of carriage 103 corresponds to that of pressure cylinder 116 of carriage 102. If pattern devices are located on the roller table 96 in the positions 130 and 131, they can be held by pressure cylinders 120 and 121.

In considering the mode of operation of the apparatus, a description will be provided of a stage of operation of the system as depicted in FIGS. 1-6. In the positions shown, a molding box 2 is located on the roller table 9 at the second shifting station 11. On the table half 38 of the rotary table 6 there is located a pattern device 4 and on the pattern device 4 a mold half 3 is arranged. As noted from FIG. 2, the mold half 3 and the pattern device 4 are located essentially at the filling station 126. The cantilever arms 154 of the lifting and turning device 1 which constitutes the second shifting means of the invention are in a position extending toward the second shifting station 11 with the clamping devices 12 opened. The cantilever arms 153 of the lifting and turning device 1 are in a position extending toward the filling station 126 and its clamping devices 16 are opened. The lifting and turning device 1 is in the lowered position, as depicted in FIG. 2. The lifting device 28 of the table half 38 is in the lowered position 37 at which the pattern device 4 is permitted to rest upon the bearing surface 5 and in which the roller conveyors 21 and 22 are not in contact with the bottom side of the pattern device 4.

The table half 39 upon which the pattern device 20 rests is in the same operational position as the table half 38 except that the table half 39 is located toward the first shifting station 125. The vacuum lines 89 and 90 are switched to a position to apply vacuum and thus the pattern device 4 is drawn or held upon the table half 38 against its bearing surface 5 and the pattern device 20 is held against the bearing surface 19 of the table half 39.

The clamping device 46 clamps the cam 44 of the table half 38 and holds it tightly. The cylinder 51 is shown in the position 52. The coupling 75 of the shifting device 61 is in the uncoupled position and the piston rods 77 are in position 80. The piston rod 84 of the cylinder 82 is in the extended position 83 and the roller 86 is in contact with the extension 85 of the push rod 69 which is in position 127. The piston rod 117 of the pressure medium cylinders 116 is in the extended position and engages the conical bores 118.

The carriage device 102 is in the position 108 and the carriage 103 is in the position 110. On the roller table 93 are placed the pattern device 94 in position 122 and the pattern device 95 in position 123. On the roller table 96 there are no pattern devices present.

The pistons of the pressure cylinders 113 and 114 are in a retracted position. The sliding device 61 is in the position 71.

In the operation for the production of a mold half, initially the clamping devices 12 or 16 are reversed and they grasp the mold box 2 or the mold half 3. The lifting and turning device 1 is switched to compressed air and lifts the molding box 2 from the roller table 9 upwardly into the position 13 or, respectively, the mold half 3 from the pattern device 4 into the position 15 as best seen in FIG. 2. Thus, as the shifting device 1 effects a lifting operation, the mold half 3 will be lifted upwardly from the pattern device 4 and separated therefrom, with the pattern device 4 being held by suction force against the bearing surface 5 of the table 38 as a result of the suction created through the line 90.

Simultaneously, the cylinder 82 is reversed and the piston rod 84 moves into the position 87 with the push rod 69 being lowered by its own weight to the position 88 from the position 127. After the shifting device 1 has travelled through a partial stroke, the clamping device 46 is reversed and the pair of clamping levers 48 move from the position 50 to the position 54 and release the cams 44 of the table half 38. The drive 7 of the shifting device 1 is now started and rotation of the shifting device 1 by a half a turn through 180° in the direction of arrow 17 is effected so that the mold half 3 is located above the roller table 9 at the second shifting station 11 and so that an empty mold box 2 which had previously been in the second shifting station 11 is now moved to the filling station 126. Simultaneously, the drive 56 of the shifting device or rotary table 6 is started and this shifting device is also turned by a half turn through 180° in the direction of the arrow 124. The pattern device 4 held on the table half 38 will thus be shifted into the first shifting station 125 with the pattern device 20 mounted upon the table half 39 being shifted from the first shifting station into position in the filling station beneath a mold box 2 which had been previously shifted into the filling station 126 by the rotation of the shifting device 1 previously described.

The shifting or lifting and turning device 1 is now switched to an exhaust operation and effects a lowering action. Thus, the mold half 3 at the second shifting station 11 is lowered onto the roller table 9 while the mold box 2 in the filling station 126 is lowered onto the pattern device 20. The cylinder 82 is also reversed and its piston rod 84 is moved into the position 83 as the push rod in 69 is lifted from the position 88 into the position 127. Subsequently, the coupling 75 is coupled with the pattern device 20 by reversing the cylinder 76 and by engagement of the piston rods 77 in the bores 78 of the coupling flange 79. By switching the vacuum 89 of table half 39 to atmospheric pressure, the suction action on the bearing surface 19 is eliminated and the pattern device 20 is released from this suction action. The clamping devices 12 and 16 are reversed thereby effecting release of the mold box 2 and the mold half 3. The lifting device of table 39, constructed in the same manner as the lifting device 28 of table half 38, is reversed and the roller conveyors of the table half 39 are lifted so that the table half 39 lifts the pattern device 20 from the bearing surface 19. The clamping device 46 is reversed in such a manner that the pair of clamping levers 48 is moved from the position 54 to the position 50 in order to hold the cam 45 of the table half 39 at station 126.

By switching on the compressed air, the lifting and turning device 1 is lifted and the sand filling device 200 operates to fill mold forming material into the mold box 2 above the pattern device 20 at the filling station 126. During this time another empty mold box 2 is moved on the roller table 9 by a predetermined distance in the direction of the arrow 10 and the finished mold half 3 previously deposited upon the second shifting station 11 is moved in the direction of the arrow 18 on the roller table 9. The actuating device 61 is started and the gear motor 62 turns by half a turn from the position 70 into the position 73 and moves the pattern device 20 including the filled mold box 2 assembled therewith in the direction of the arrow 60 over the roller conveyor 58 from the filling station 126 into the molding unit 59.

After the mold material has been compacted, the gear motor 62 is once again started and the drive crank 64 is moved from the position 73 into the position 70 thereby actuating the pattern device 20 and the filled and compressed mold half assembled therewith back into the filling 126.

At this point, the lifting device of the table half 39 is reversed and the pattern device 20 together with its assembled filled mold half is lowered onto the bearing surface 19. By reversing the shifting device 1, it is lowered into the position shown in FIG. 2. At this point the vacuum line 89 is switched on and vacuum is applied. The coupling 75 is uncoupled and the sequence of operation for producing a mold half has ended.

When the required amount of mold halves has been produced by the pattern devices 4 and 20 in the continuous operation previously described, an exchange of pattern devices may be carried out. This may be effected by moving the pattern device 20 first into the switching station 125 whereupon the pressure medium cylinder 128 is reversed and its piston rod operates to engage the coupling flange of the pattern device 20. The vacuum line 89 is switched to atmospheric pressure. By reversing the lifting device of the table half 39, the table half is lifted and its lifts the pattern device 20 off from the bearing surface 19. The pressure medium cylinders 113 and 114 are simultaneously reversed and release the pattern devices 94 and 95. The pressure cylinder 98 is now reversed and moves the carriage 102 from the position 108 into the position 109 with the carriage 103 moving from the position 110 into the position 111. Thus, the pattern device 20 is moved from the table half 39 into the position 130, the pattern device 94 is moved onto the table half 39 and the pattern device 95 is moved into the position 122. The pressure cylinder 113 and 120 may now be reversed and the pattern device 95 or 20 will be held in the position 122 or 130, respectively.

The lifting device of the table half 39 is reversed and the pattern device 94 is lowered onto the bearing surface 19. The pressure medium cylinders 116 or 128 of the carriage 102 or 103 are reversed and the coupling rods 117 move to the position 119 (see FIG. 3*b*). Subsequently, the pressure medium cylinder 98 is reversed and moves the carriage 102 from the position 109 to the position 108 and, respectively, the carriage 103 from the position 111 to the position 110. When the next mold half is finished, the sequence previously described is repeated in an analogous fashion. The pattern device 20 is moved from the position 130 into the position 131 and the pattern device 4 is moved from the table half 38 to the position 130 with the pattern device 95 being moved from the position 122 onto the table half 38. Thus, the operational exchange of pattern devices 4 and 20, as well as of 95 and 94 is carried out. The roller conveyor 93 serves as a standby position device in order to enable receipt of additional pattern devices which are to be placed in operation during the time in which the first pair of pattern devices 20 and 4 are in operation.

The apparatus according to FIGS. 1–6 allows alternate production of mold halves in the form of copes and drags which when assembled may form complete molds. This may be accomplished by means of a single-station molding unit, such as the molding unit 59 and by utilization of two pattern devices. Furthermore, the apparatus makes it possible to check each of the pattern devices after each production cycle of a corresponding mold during the time that the rotary table or shifting device 6 is in idle position. This will permit placement of iron chills or permit performance of other operations on the pattern devices. The exchange of pattern devices which may be readily taken out of operation by other pattern devices are made available for the exchange may be performed at any time between mold forming operations.

Figure 7:
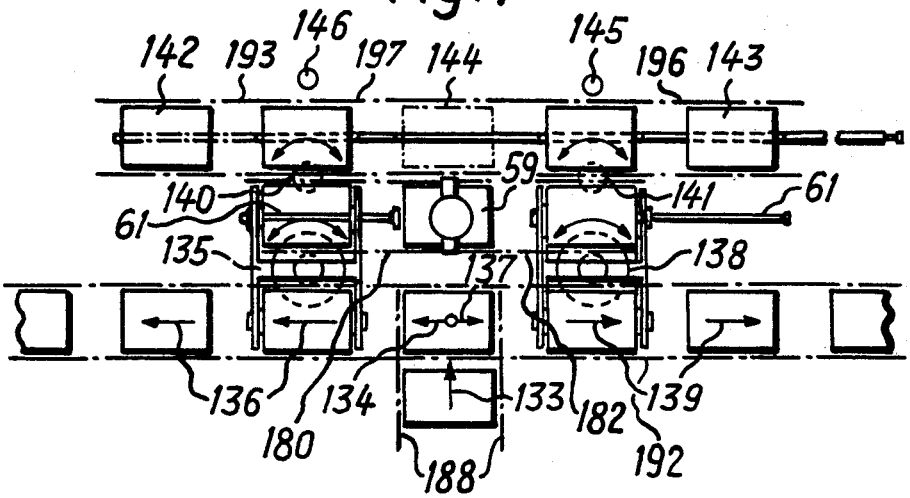
FIG. 7 is a plan view depicting a second embodiment of the invention.

A further embodiment of the invention is shown in FIG. 7 which depicts apparatus allowing alternate production of two different molds or mold halves. Accordingly, four different pattern devices, that is, two pattern devices for each cope and two pattern devices for each drag, will be in operation at the same time.

The embodiment shown in FIG. 7 differs from the embodiment shown in FIGS. 1–6 essentially in that the shifting devices for the mold boxes and the pattern devices are arranged in a twin formation with a sand filling device being assigned to each pair of shifting devices. Both pairs of shifting devices, each having a lifting and turning device 135 or 138 and a rotary table 140 or 141, cooperate with a joint single-station molding unit 59 through one sliding track 180 or 182, respectively. Each of the pattern devices (not shown) for the two copes and the two drags are assigned to one of the two rotary tables and it shall be assumed that the rotary table 140 carries the pattern devices for the upper mold halves and the rotary table 141 carries the two pattern devices for the lower halves. Mold boxes conveyed on a conveyor track 188 in the direction of arrow 133 are alternately received by a roller conveyor 190 or 192 and are delivered thereon in the direction of arrows 134 or 137 to the corresponding lifting and turning device 135 or 138. Finished mold halves are removed on opposite sides with the copes being removed on the roller conveyor 190 in the direction of arrow 136 while the drags are removed on the roller conveyor 192 in the direction of the arrow 139.

The sequence of operation for the production of mold halves is carried out in the same manner as previously described in connection with the embodiment depicted in FIGS. 1–6. However, the production of copes and drags is effected in a sequence displaced in phase by half a working cycle.

When a pattern device for one of two mold halves is to be exchanged, a new pattern device for the other mold half which is in standby position 143 on the roller table 196 is placed upon the rotary table 141 while the corresponding pattern device for another mold half in operation is moved by the rotary table 141 into the position 144 on roller table 197, this roller table 197 extending between two roller tables 196 and 193 and being arranged coaxially relative to the latter. Since the distance for securing the cores to the point where the molds are enclosed has a larger number of drags than copes, the resulting shift in the time of the exchange of the pattern devices for the copes can be utilized to remove the already exchanged pattern device for the drags located on roller table 197. After a predetermined number of working cycles have been effected, the pattern device for the copes is exchanged by moving the pattern device in operation from the rotary table 140 into the position 141 on the roller table 197, while the new pattern device put in readiness is moved from the position 142 on the roller table 193 onto the rotary table 140. When the pattern devices in operation are in waiting position, it is possible to perform work on the apparatus when standing in the positions 146 and 145.

Figure 8:
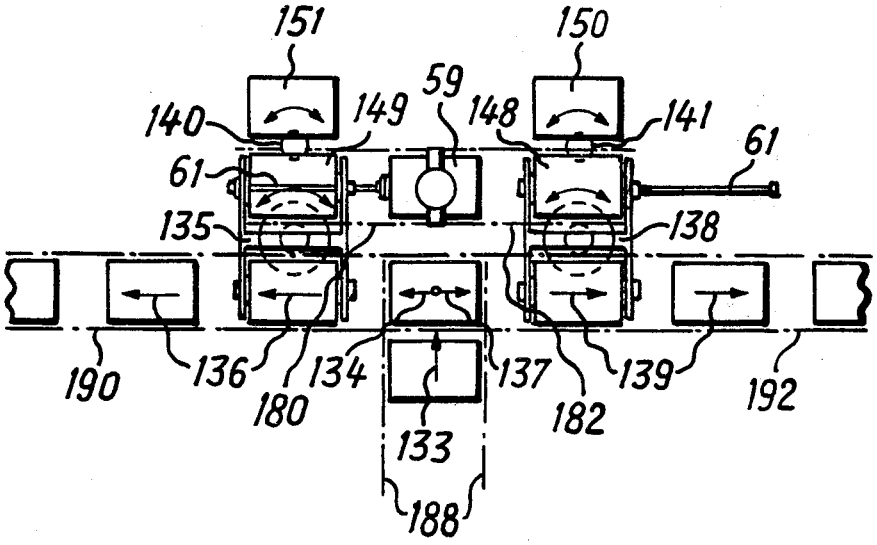
FIG. 8 is a plan view depicting a third embodiment of the invention which constitutes a modification of the embodiment shown in FIG. 7.

FIG. 8 depicts another embodiment of the apparatus. This apparatus is suitable for the production of molds for expensive series of castings. Therefore, compared to the embodiments shown in FIGS. 1–6 or in FIG. 7, roller tables for the mechanized exchange of pattern devices are not necessary. Furthermore, in pattern devices for extensive series of castings, it is also not necessary to move the pattern devices into positions in which the performance of manual work between the production of individual mold halves is possible since, in this case, only pattern devices of unobjectionable quality with tried casting systems are used.

The movement of the mold boxes and the production of the mold halves, as well as the further conveying of the mold halves, is carried in the manner according to FIG. 7. However, the rotary table 141 carrying the pattern devices for the lower mold halves and the rotary table 140 carrying the pattern devices for the copes are not rotated during production. The table halves 148 and 149 carry the pattern devices in operation while table halves 150 and 151 carry those pattern devices which are in standby position for pattern device exchange.

When an exchange of pattern devices for the drags is to be performed, the rotary table 141 is turned by half a turn in a single movement. After a predetermined number of cycles is performed, the operational exchange of the pattern device for the copes is performed in the same manner by a single turn of the rotary table 140. The exchange of the pattern device in standby position is performed in the time period available between the operational exchanges of pattern devices. The embodiment according to FIG. 8 may also be used for the selctive or alternate production of two different molds. However, it usually produces only a single type of mold.

While specific embodiments of the invention have been shown and described in detail to illustrate the application of the inventive principles, it will be understood that the invention may be embodied otherwise without departing from such principles.

What is claimed is:

1. Apparatus for the production of molds comprising: filling means arranged vertically above a filling station for filling with mold forming material mold boxes positioned at said filling station, first shifting means for shifting pattern devices between a first shifting station and said filling station, second shifting means for shifting mold boxes between a second shifting station and said filling station, first conveyor means for selectively transporting pattern devices relative to said first shifting means to and from said first shifting station, second conveyor means for feeding mold boxes to said second shifting means at said second shifting station and for transporting molds therefrom, a single-station mold forming unit for performing mold forming operations on mold boxes filled with molding material, and third conveyor means for transporting filled mold boxes with assembled pattern devices from said filling station to said single-station mold forming unit and molds and pattern devices back to said filling station, said first and second shifting means each having an axis of rotation and operating to move said pattern devices and said mold boxes, respectively, about said axis through respective rotary paths each defining a respective pitch radius, said first and said second shifting means being arranged on opposite sides of said filling station with their axes of rotation spaced apart a distance equivalent to the sum of said pitch radii, with said first and second shifting means operating to locate said mold boxes and said pattern devices at said filling station with said mold boxes above said pattern devices.

2. Apparatus according to claim 1 wherein said second shifting device comprises pairs of cantilever arms operable to be jointly raised and lowered which are arranged to extend oppositely relative to the axis of rotation of said shifting device, and clamping jaws mounted on said cantilever arms, said first shifting device comprising two table halves arranged in diametrically opposed relationship relative to the axis of rotation of said first shifting device, each of said table halves having sets of rollers arranged relative to said respective table half to be raised and lowered, said sets of rollers forming a portion of said third conveyor means when located at said filling station.

3. Apparatus according to claim 2 wherein each of said table halves has a cam thereon and wherein a stationary controllable clamping is provided for temporarily holding said first shifting device through said cam of said table half when the latter is carrying a mold box.

4. Apparatus according to claim 2 wherein each of said sets of rollers is horizontally guided in its respective table half at a guide face, with each set including rollers having rims formed thereon.

5. Apparatus according to claim 2 wherein a controllable vacuum line is connected to each table surface of said table halves through which a pattern device may be temporarily held upon said table surface.

6. Apparatus according to claim 2 wherein each table half includes a lifting device connected to the corresponding set of rollers thereon, said table halves each including faces for limiting the height to which said rollers are lifted.

7. Apparatus according to claim 2 wherein said third conveyor means comprise a roller conveyor, said apparatus further comprising actuating means adapted to be coupled and decoupled to and from each pattern device to propel said pattern device along said roller conveyor between said mold forming unit and said filling station.

8. Apparatus according to claim 1 wherein said first conveyor means comprise coaxially arranged roller tables operatively associated with said first shifting device and defining a standby position of said pattern devices from which said pattern devices may be moved to said first shifting station, said roller tables including actuating means for transporting said pattern devices therealong.

9. Apparatus according to claim 1 wherein said filling means comprise two sand filling devices, said two sand filling devices being arranged one on each side of said single-station molding unit on opposite sides thereof.

10. Apparatus according to claim 8 or 9 wherein a common roller table is arranged between said shifting devices in order to define the standby position of pattern devices and to carry while in waiting positions two pattern devices.

11. Apparatus for the production of foundry molds comprising filling means arranged at a filling station for filling with mold forming material mold boxes positioned at said filling station, first shifting means for shifting pattern devices between a first shifting station and said filling station, second shifting means for shifting mold boxes between a second shifting station and said filling station, a mold forming unit, first conveyor means for transporting pattern devices to and from said first shifting station, second conveyor means for transporting empty mold boxes to said second shifting station and for transporting molds from said second shifting station, and third conveyor means for transporting mold forming assemblies including a mold box and a pattern device filled with mold forming material from said filling station to said mold forming unit and returning molds and pattern devices back to said filling station, said first shifting device operating to shift a first pattern device from said first shifting station into position for assembly with an empty mold box at said filling station while simultaneously shifting another pattern device disassembled from a mold from said filling station back to said first shifting station, said second shifting means operating to shift an empty mold box from said second shifting station to said filling station to enable assembly with a pattern device at said filling station and filling by said filling means for subsequent transfer to and from said mold forming unit, said second shifting means simultaneously shifting a mold separated from a pattern device back to said second shifting station for transport away therefrom by said second conveyor means.

12. Apparatus for the production of foundry molds comprising filling means arranged at a filling station for filling with mold forming material mold boxes positioned at said filling station, first shifting means for shifting a pattern device from a first shifting station to said filling station and for simultaneously shifting another pattern device from said filling station to said first shifting station, second shifting means for shifting an empty mold box from a second shifting station to said filling station in position for assembly with said pattern device and for simultaneously shifting a filled mold box constituting a mold unit from said filling station to said second shifting station, a mold forming unit, first conveyor means for transporting pattern devices to and from said first shifting station, second conveyor means for transporting empty mold boxes to said second shifting station and for transporting filled mold boxes away from said second shifting station, and third conveyor means for transporting mold assemblies filled with mold forming material and including an assembled mold box and pattern device from said filling station to said mold forming unit and back to said filling station, said first and second shifting means comprising rotary devices located on diametrically opposed sides of said filling station an operating to move said pattern devices and said mold boxes, respectively, through generally semicircular paths between said first and second shifting stations, respectively, and said filling station.

13. Apparatus according to claim 12 wherein said first, second and third conveyor means extend in generally parallel relationship to each other.

14. Apparatus according to claim 12 wherein said first shifting means is located between said first and third conveyor means and wherein said second shifting means is located between said second and third conveyor means.

15. A method for the production of foundry molds comprising the steps of moving a pattern device to a first shifting station, moving an empty mold box to a second shifting station, moving both said pattern device and said empty mold box to a filling station, said first and second shifting stations being located on generally opposite sides of said filling station, assembling said pattern device and said empty mold box at said filling station and filling said assembly with mold forming material, transporting said filled mold assembly to a mold forming unit and effecting mold forming operations thereon and subsequently returning said mold assembly to said filling station, separating said pattern device from said filled mold box at said filling station, moving another pattern device to said first shifting station, thereafter moving said separated pattern device from said filling station to said first shifting station while simultaneously moving said another pattern device from said first shifting station to said filling station, moving another empty mold box to said second shifting station, thereafter moving said filled molding box from said filling station to said second shifting station while simultaneously moving said another empty mold box from said second shifting station to said filling station and transporting said filled mold box from said second shifting station.

16. A method according to claim 15 wherein each of said steps of said method are repeatedly performed to conduct a continuous mold forming operation.

17. A method according to claim 15 wherein a plurality of differently configured pattern devices are selectively introduced to and removed from said first shifting station for selective utilization in forming molds.

18. A method according to claim 15 wherein each pattern device and each mold box is utilized to produce a mold half adapted to be assembled with another mold half similarly produced by said method for assembly after transporting of both said mold halves from said second shifting station.

19. A method according to claim 15 wherein movement of pattern devices between said first shifting station and said filling station, and movement of said mold boxes between said second shifting station and said filling station is effected by moving said devices and boxes through a generally circular path, said pattern devices being moved through one-half of said circular path when moving from said first shifting station to said filling station and through the other half of said circular path when moving from said filling station back to said shifting station, said mold boxes likewise being moved through one-half of another circular path when moving from said second shifting station to said filling station and through the other half of said another circular path when moving from said filling station back to said second shifting station.

20. A method according to claim 15 wherein a plurality of differently configured pattern devices are utilized by removing from said first shifting station a pattern device previously utilized in forming a mold and substituting therefor at said first shifting station another pattern device.

* * * * *